United States Patent [19]

Chow

[11] Patent Number: 4,722,253

[45] Date of Patent: Feb. 2, 1988

[54] REVERSIBLE RATCHET WRENCH WITH ONE-HAND ACCESSIBLE SWITCH

[76] Inventor: Jessie Chow, 18, Hou Tswang Road, Pei Twen District, Taichung, Taiwan, 40660

[21] Appl. No.: 5,842

[22] Filed: Jan. 21, 1987

[51] Int. Cl.[4] ..... B25B 13/46

[52] U.S. Cl. ..... 81/63; 81/62

[58] Field of Search ..... 81/63, 60, 61, 62, 63.1, 81/63.2

[56] References Cited

U.S. PATENT DOCUMENTS

| | | | |
|---|---|---|---|
| 1,635,102 | 7/1927 | Watson | 81/63 |
| 4,445,404 | 5/1984 | Parker | 81/62 |
| 4,566,356 | 1/1986 | Herota | 81/62 |

*Primary Examiner*—Frederick R. Schmidt
*Assistant Examiner*—Robert Showalter
*Attorney, Agent, or Firm*—Morton J. Rosenberg

[57] ABSTRACT

A reversible ratchet wrench comprising an elongated housing whose head portion encloses a ratchet wheel and a pawl. The orientation of the pawl determines one of two driving directions of the ratchet wheel, to which is connected a square driving member. An elongated groove containing a control device and an arcuate spring strip is provided on the upper surface of the housing. The front end of the arcuate spring strip contacts with one lateral side of the pawl, and the rear end of the spring strip is retained by the control device. The control device comprises a control switch which is controlled by the thumb or other fingers of the hand grasping the wrench, with a fixing spring assembly enabling the control switch to be fixed in place. An upper cover plate and a lower cover plate enclose the elongated housing of the ratchet wrench.

1 Claim, 6 Drawing Figures

REVERSIBLE RATCHET WRENCH WITH ONE-HAND ACCESSIBLE SWITCH

BACKGROUND OF THE INVENTION

This invention relates to a reversible ratchet wrench with a control switch that is subject to be controlled by the thumb or other fingers of the hand grasping the ratchet wrench.

The reversible ratchet wrench is a popular mechanical tool used to tighten or loosen threaded elements, e.g. nuts and bolts. The reversible ratchet wrench converts a continuous rocking movement into an intermittent rotational movement. Therefore, the time required to tighten or loosen the threaded elements is shortened and its operations are also simplified. However, conventional reversible ratchet wrenches still have a few drawbacks which will be described in detail hereinafter. Two conventional reversible ratchet wrenches, 100 and 110, with corresponding control switches, 105 and 115, are shown in FIG. 5 and 6, respectively. In both above-referenced conventional ratchet wrenches 100 and 110, the control switches 105 and 115, which change the driving directions of the ratchet wrenches, are disposed at (or near) the head portion thereof. The control switches of conventional ratchet wrenches, such as shown in FIG. 5 and 6, are not accessible to the same hand that grasps the ratchet wrench. Hence, it would be necessary to first detach the wrench from the tool intended to be driven and then to turn the control switch with another hand when the driving direction of the ratchet wrench is to be changed. This would therefore cause the operation to be inconvenient. In addition, when a bolt or a nut has been attached to the threaded hole but is still in a loose-connection situation, the reverse (non-driving) rotation would cause the bolt or nut to move in the reverse direction due to the significant friction between the ratchet wheel and the pawl. Therefore, it is usually necessary to rotate the bolt or nut to a semi-tightened situation by hand and then to further tighten it by the ratchet wrench. This would be the same condition as that when the bolt or nut has been loosened to a loose-connection situation, in which it would be necessary to further loosen the bolt or nut by hand. Conventional reversible ratchet wrenches therefore still waste time and involve a complicated procedure as described in the above-described operation.

SUMMARY

A primary objective of the present invention is therefore to provide a reversible ratchet wrench which can mitigate and/or obviate the above-described drawbacks of the conventional reversible ratchet wrenches.

Another objective of the present invention is to provide a reversible ratchet wrench wherein the control switch is disposed at the midportion of the ratchet wrench so as to enable the user to change the driving directions thereof with the thumb or other fingers of the same hand, which is grasping the ratchet wrench.

A further objective of the present invention is to provide a reversible ratchet wrench wherein the resistant friction of the reverse (non-driving) rotation of the wrench is negligible.

Further objectives and advantages of the present invention will become apparent as the following description proceeds, and the features of novelty which characterize the invention be pointed out with particularity in the claims annexed to and forming a part of this invention.

DETAILED DESCRIPTION OF THE PREFERRED EMBODIMENT

Figure 1:
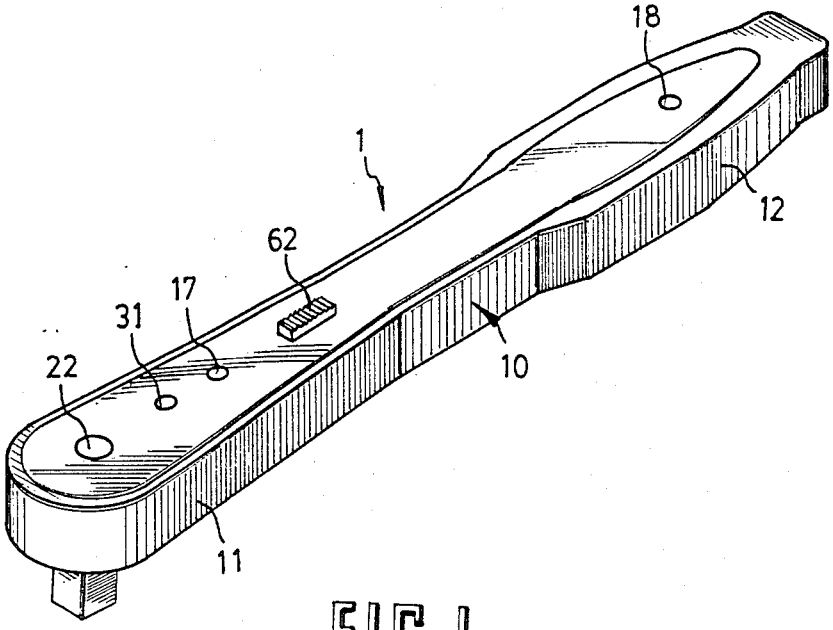
FIG. 1 is a perspective view of the reversible ratchet wrench according to the present invention.
Figure 2:
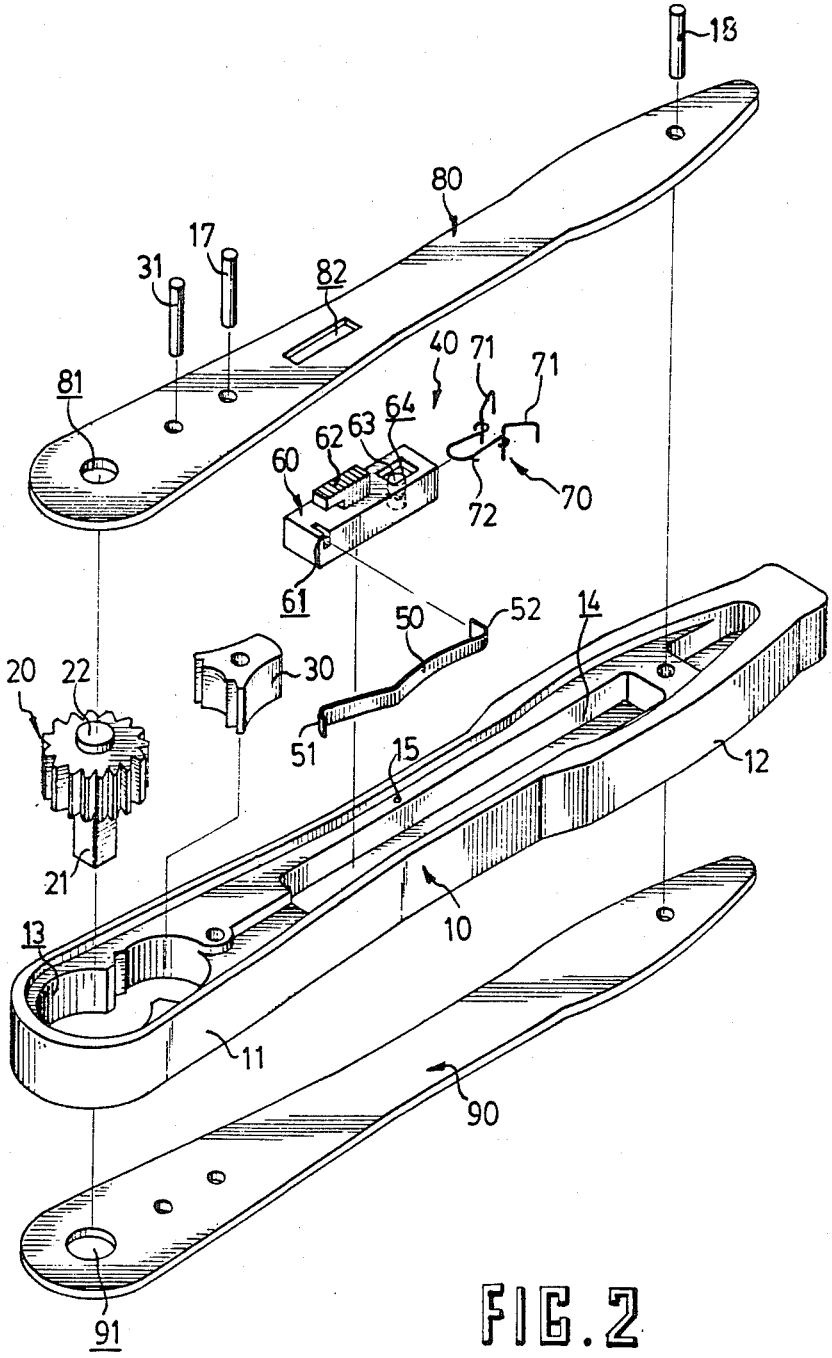
FIG. 2 is an exploded view of the reversible ratchet wrench according to the present invention.

Referring now to the drawings, particularly to FIGS. 1 and 2 thereof, the reversible ratchet wrench 1 according to the present invention comprises an elongated body or housing 10. The enlongated body or housing 10 includes a head portion 11 and a handle grasping portion 12. A penetrating ratchet slot 13 is provided in the head portion 11 for receiving a ratchet wheel 20 and a pawl 30. An elongated groove 14 is provided on the upper surface of the housing 10 from an appropriate position behind the head portion 11 until the handle grasping portion 12. A flat upper cover plate 80 and lower cover plate 90 are secured to the top and bottom sides of the housing 10, respectively. The elongated groove 14 contains a control device 40 for choosing the driving direction of the ratchet wrench 1, which comprises an arcuate spring strip 50, a control switch 60 and a fixing spring assembly 70. The ratchet wheel 20 is provided with a square driving member 21 on the lower surface thereof, which is intended to engage with any suitable sleeve for driving, tightening or loosening, a connected bolt or nut. The upper surface of the ratchet wheel 20 is provided with a circular protuberance 22. The pawl 30 is adapted to engage with the ratchet wheel 20 in two positions, each position enabling the ratchet wheel 20 to drive the connected bolt or nut in a specific direction, either clockwise or counterclockwise. Since the operation of a pawl 30 activating a ratchet wheel 20 in one direction and to de-activating a ratchet wheel 20 in the opposite direction is conventional knowledge, it will not be described in detail herewith. The ratchet wheel 20 is rotatably mounted on the head portion 11 of the housing 10. The circular protuberance 22 and the square driving member 21 are adapted to the retaining hole 81 on the upper cover plate 80 and the retaining hole 91 on the lower cover plate 90, respectively. The pawl 30 is also rotatably mounted in the head portion 11 of the housing 10 and behind the ratchet wheel 20 with a fastening pin 31 going through the pawl 30.

Figure 3:
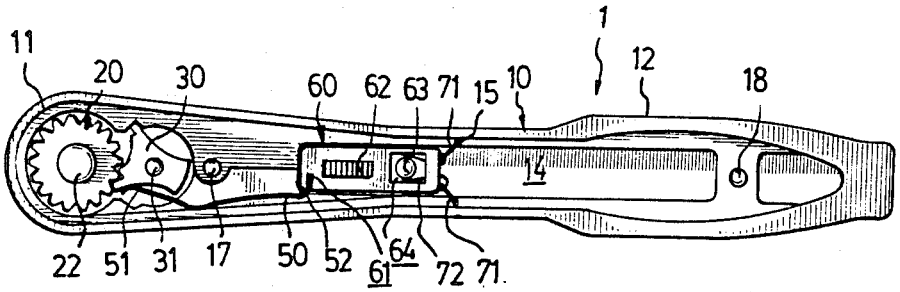
FIG. 3 is a top plan view, of the reversible ratchet wrench, with the cover plate removed, showing the ratchet wrench turning the tool in a clockwise direction.
Figure 4:
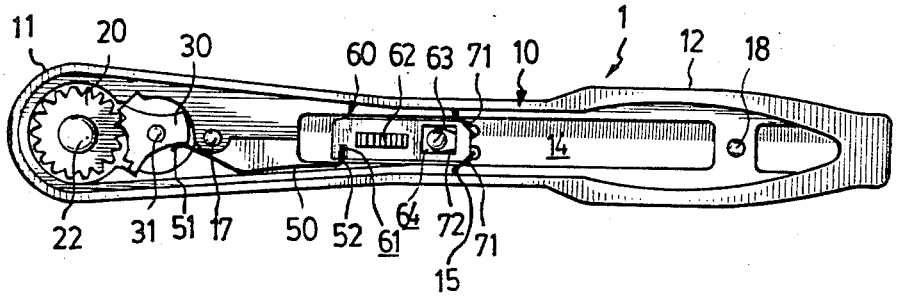
FIG. 4 is another top plan view of the ratchet wrench, shown with the cover removed, during the turning of the tool in the counterclockwise direction.
Figure 5:
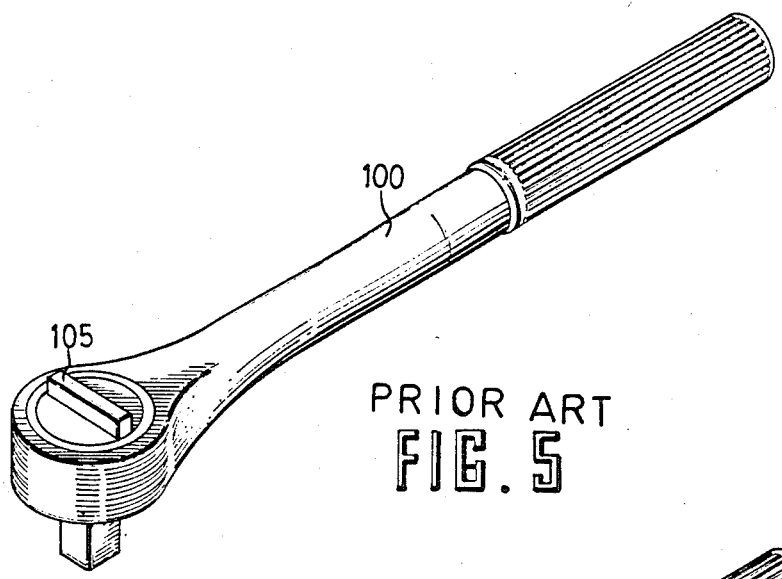
PRIOR ART FIG. 5
FIG. 5 shows a conventional reversible ratchet wrench.
Figure 6:
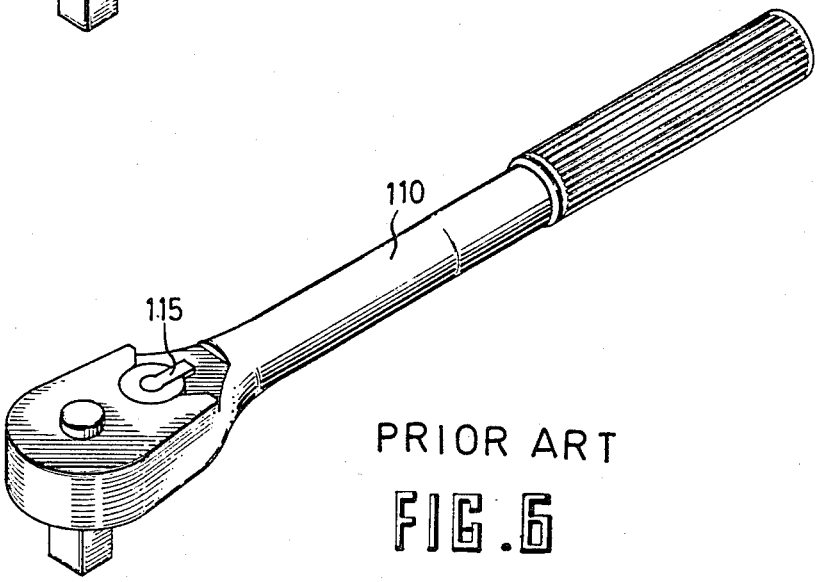
PRIOR ART FIG. 6
FIG. 6 shows a second conventional reversible ratchet wrench.

Referring further of FIGS. 3 and 4, it can be seen that the arcuate spring strip 50 has a front end 51 and a rear end 52. The front end 51 of the spring strip 50 contacts with one lateral side of the pawl 30 so as to control the orientation thereof. The rear end 52 of the spring strip 50 is retained in a strip slot 61 provided on the front portion of the control switch 60. The control switch 60 is slidably disposed in the elongated groove 14. The upper surface of the control switch 60 has a control member 62 with serrated surface attached thereon. A protruding switch slot 82 is provided on the midportion of the upper cover plate 80 such that the control member 62 may be pushed forward or rearward from the outer surface of the housing 10. The user has access to the control member 62 with the thumb or other fingers of the hand grasping the handle grasping portion 12, as the control switch 60 is disposed in the midportion of the housing 10. Since the control member 62 is fixed to the control switch 60, the movement of the control switch 60 is then in accordance with the control member 62. A fixing spring assembly 70 comprises a pair of fixing rods 71 and a U-shaped spring 72. Each of the two fixing rods 71 is rotatably set in one of the two side holes 15, being provided on either side of the elongated groove 14. Each end of the U-shaped spring 72 is hooked and is therefore retained by the inner leg of one of the pair of fixing rods 71. The middle portion of the U-shaped spring 72 is further retained by a post 63 with a circumferential groove thereon. The post 63 is disposed in a recess 64 which is provided in the rear portion of the control switch 60. The U-shaped spring 72 is hence connected to the control switch 60 by inserting into the recess 64 and securing to the post 63. The upper and lower cover plates 80 and 90 are secured to the housing 10 by fastening means, e.g. pins 17 and 18, one on either end of the ratchet wrench 1, respectively.

Referring now to FIGS. 3 and 4, the change-driving direction operation of the ratchet wrench 1 will be described. As shown in FIG. 1, the control switch 60 is pushed forward and locates therefore in the position which enables the driving member 21 of the ratchet wheel 20 to clockwise drive the bolt or nut to be tightened or loosened. The front end 51 of the arcuate spring strip 50 pivotally pushes the pawl 30 into the present orientation as a result of the arcuate spring strip 50 being pushed forward by the control switch 60. If the user now intends to counterclockwise drive the bolt or nut, the control switch 60 should be pushed rearward into the position as shown in FIG. 4. When the control switch 60 is moved, from the position as shown in FIG. 3, toward the specific position as shown in FIG. 4, or vice versa, the U-shaped spring 72 must receive energy so as to be deformed (i.e. to get both ends thereof closer) before the ends of the spring 72 can pass between the side holes 15. Accordingly, the U-shaped spring 72 provides a supplementary force to facilitate the control switch 60 to reach and remain in either of the two pre-determined positions, as shown in FIGS. 3 and 4. When the control switch 60 is pushed rearward to the position as shown in FIG. 4, the front end 51 of the pawl 50 then pivotally pushes the ratchet wheel 20 into the position in which the ratchet wrench is able to counterclockwise drive the attached bolt or nut. Furthermore, it is noted that the friction between the ratchet wheel 20 and the pawl 30 is quite small as compared with conventional ratchet wrenches when the ratchet wrench 1 is reversely (non-driving) rotated. The counterclockwise stroke of the ratchet wrench, in the FIG. 3, as an instance of a reverse rotation, forces the teeth of the ratchet wheel 20 to clockwise slide against and over the pawl 30. Since the arcuate spring strip 50 has a low efficient of elasticity in its lateral direction, the ratchet wrench 1 is therefore able to achieve it is reverse stroke with a small amount of friction. Hence, even when the bolt or nut is in a loosened situation, the ratchet wrench 1 according to the present invention can rock back without reversely rotating the bolt or nut. Accordingly, once a bolt or nut is attached to the threaded hole, the ratchet wrench 1 can be used to efficiently accomplish all the above-mentioned processes, no matter whether during the driving stroke or the non-driving stroke.

As various possible embodiments might be made of the above invention, and as various adaptations might be made in the embodiment above set forth, it is to be understood that all matter herein described or shown in the accompanying drawings is to be interpreted as illustrative and not in a limiting sense. Thus it will be appreciated that the drawings are exemplary of the preferred embodiment of the invention.

I claim:

1. A reversible ratchet wrench with one-hand accessible switch comprising:

an elongated housing with a ratchet slot provided in a head portion thereof and an elongated groove spanning from behind said head portion to a handle grasping portion of the elongated housing;

an upper and a lower cover plate attached to said elongated housing by fastening means, a retaining hole being provided on the front portion of each cover plate, a switch slot being provided on the midportion of said upper cover plate;

a ratchet wheel having a square driving member on it lower surface and a circular protuberance on its upper surface, said ratchet wheel being rotatably mounted in said head portion;

a pawl rotatably mounted in said head portion by a pin, said pawl being adapted to engage with said ratchet wheel in two distinct positions each of which enables said ratchet wheel to drive a bolt or nut in a specific direction;

a control switch having a control member attached on the upper surface thereof, said control member protruding from said switch slot, a strip slot being provided on the front portion of said control switch, a recess being provided in the rear portion of said control switch, a post with a circumferential groove being disposed in said recess;

an arcuate spring strip, the front end of said arcuate spring strip contacting one lateral side of said pawl and the rear end of said arcuate spring strip being retained by said strip slot;

a U-shaped spring with two hooked ends, the midportion of said U-shaped spring being retained by said post; and a pair of fixing rods, each of said fixing rods being rotatably set in one of a pair of side holes each of which are provided on either side of said elongated groove, the inner leg of each fixing rod retaining one hooked end of said U-shaped spring, whereby when said control switch and U-shaped spring are moved to a first position the arcuate spring strip positions said pawl to engage said ratchet wheel for driving in a first direction and when said switch and U-shaped spring are moved to a second position the spring strip positions said pawl to engage said ratchet wheel for driving in a second direction.

* * * * *